US011673288B2

(12) United States Patent
Coolbaugh

(10) Patent No.: US 11,673,288 B2
(45) Date of Patent: Jun. 13, 2023

(54) BATTERY POWERED PORTABLE LOG SPLITTER

(71) Applicant: David Coolbaugh, Lakeville, MN (US)

(72) Inventor: David Coolbaugh, Lakeville, MN (US)

( * ) Notice: Subject to any disclaimer, the term of this patent is extended or adjusted under 35 U.S.C. 154(b) by 23 days.

(21) Appl. No.: 17/583,388

(22) Filed: Jan. 25, 2022

(65) Prior Publication Data

US 2022/0234242 A1 Jul. 28, 2022

Related U.S. Application Data

(60) Provisional application No. 63/142,193, filed on Jan. 27, 2021.

(51) Int. Cl.
*B27L 7/06* (2006.01)

(52) U.S. Cl.
CPC ..... *B27L 7/06* (2013.01)

(58) Field of Classification Search
CPC ..... B27L 7/00; B27L 7/06
See application file for complete search history.

(56) References Cited

U.S. PATENT DOCUMENTS

| | | | | |
|---|---|---|---|---|
| 4,239,070 A * | 12/1980 | Burns | B27L 7/00 144/195.1 |
| 6,076,576 A * | 6/2000 | Maddox | B27L 7/00 144/195.1 |
| 8,511,354 B2 * | 8/2013 | Schamberger | B27L 7/00 144/195.1 |
| 10,118,309 B2 * | 11/2018 | Bowman | B27L 7/00 |
| 2013/0098503 A1 * | 4/2013 | Shaeffer | B27L 7/00 144/195.1 |
| 2022/0234241 A1 * | 7/2022 | Smith | B27L 7/06 |

* cited by examiner

*Primary Examiner* — Matthew Katcoff
(74) *Attorney, Agent, or Firm* — Brennan, Manna & Diamond, LLC

(57) ABSTRACT

The present invention relates to a Li-Ion battery powered log splitter. The log splitter includes a steel frame having height adjustable legs and wheels for making the device both adjustable vertically and portable. The log splitter also features a hydraulic pump system powered by an integrated direct current (DC) motor. The DC motor receives power from the Li-Ion battery and spins the pump system for activating a steel plate and rod mechanism to section a log of wood placed on a track of the log splitter into at least two pieces. The size and output of the batteries, motor, and pump can be increased or decreased to suit user preference or need, and users can easily operate the log splitter to easily and safely split wood into sections or pieces for campfires, outdoor fire pits, ovens and much more.

20 Claims, 5 Drawing Sheets

BATTERY POWERED PORTABLE LOG SPLITTER

CROSS-REFERENCE TO RELATED APPLICATION

The present application claims priority to, and the benefit of, U.S. Provisional Application No. 63/142,193, which was filed on Jan. 27, 2021 and is incorporated herein by reference in its entirety.

FIELD OF THE INVENTION

The present invention relates generally to the field of log splitters. More specifically, the invention relates to a battery-operated portable log splitter that does not require gas or any other fossil fuel for operation. Further, the log splitter does not require electric cords associated with conventional electric log splitters for operation. More specifically, the log splitter includes Li-Ion batteries, a hydraulic pump system and a DC motor for operation. The lithium-ion batteries power the direct current motor, which in turn operates the hydraulic pump system for splitting a log of wood. Accordingly, the present disclosure makes specific reference thereto. Nonetheless, it is to be appreciated that aspects of the present invention are also equally applicable to other like applications, devices and methods of manufacture.

BACKGROUND

By way of background, there currently exists many known structures for splitting logs and firewood. Log splitters are in common use that supports a log between a ram and a wedge-shaped splitting blade, wherein a ram with a push plate engages one end of the log and moves the log into forceful engagement with the sharp edge of the splitting blade and continues the movement of the log relative to the blade to effect a splitting of the log. Generally, gas powered log and firewood splitters are used by people that can be used for tougher and larger logs as well. Such gas-powered splitters are expensive and require regular maintenance. Further, gas-powered splitters need oil changes, air filter changes and regular fuel additions.

Gas-powered splitters are loud and cannot be used indoors. Further, they are heavy and cumbersome to transport. With time, fuel consumption of the gas-powered splitters increases which is expensive, and also consumption of fossil fuels is incredibly harmful for the environment.

Conventional electric corded models require a great deal of electric cords which can be prohibitive for an effective log splitting operation, for example, remote from dwellings. Further, such models may provide low power performance. People desire an improved log splitter that overcomes the problems associated with the gas-powered and electric corded models.

Therefore, there exists a long felt need in the art for a log splitter that does not cause pollution in the environment. There is also a long felt need in the art for a log splitter that does not use gas or other fossil fuels. Additionally, there is a long felt need in the art for a log splitter that requires less maintenance. Moreover, there is a long felt need in the art for a log splitter that can be used for indoor purposes and by a single person. Further, there is a long felt need in the art for a log splitter that is comparatively lightweight and easily portable. Furthermore, there is a long felt need in the art for a log splitter that does not require electrical cords during operation. Finally, there is a long felt need in the art for a log splitter that replaces gas-powered log splitters and eliminates the necessity of having to deal with electrical cords or lower power performance during operation commonly associated with electric corded models.

The subject matter disclosed and claimed herein, in one embodiment thereof, comprises a battery-operated cordless log splitter. The battery-operated portable log splitter is configured to replace gas-powered log splitters and obviates the necessity of having to deal with electrical cords or lower power performance during operation of conventional electric corded models. The battery-operated portable log splitter features lithium-ion batteries for providing electric power, a hydraulic pump system for performing a hydraulic function for splitting logs, a direct current (DC) motor for activating the hydraulic pump system where the DC motor receives DC supply from the lithium-ion batteries, a track disposed between two rails along the steel frame wherein the logs of wood slide along the track using a steel plate or wedge for splitting by pushing a rod through the wood. The DC motor eliminates the use of any conventional alternating current (AC) supply for operating the log splitter and thus makes the log splitter operable in all conditions.

In this manner, the battery powered portable log splitter of the present invention accomplishes all of the forgoing objectives and provides users with a battery-powered log splitter equipped with an integrated Li-Ion batteries. The log splitter enables users to maintain a considerable amount of wood for outdoor firepits, wood-fired ovens, boilers, campfires and more. Further, the log splitter replaces gas-powered log splitters which can be harmful for the environment and obviates the necessity of having to deal with electrical cords or lower power performance during operation commonly associated with electric corded models.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a battery-operated portable log splitter. The battery-operated portable log splitter further comprising a steel frame having a front end and a rear end, folding and height-adjustable legs positioned near the front end, rear wheels positioned at the rear end, lithium-ion batteries for providing electric power, a hydraulic pump system for performing hydraulic mechanism for splitting logs, a direct current (DC) motor for activating the hydraulic pump system where the DC motor receives DC supply from the lithium-ion batteries, a track disposed between two rails along the steel frame wherein the logs of wood slide along the track using a steel plate or wedge for splitting by pushing a rod through the wood.

In yet another embodiment, the hydraulic pump system includes a fluid reservoir for storing hydraulic fluid wherein the fluid is passed to a valve by a hydraulic pump for actuating a hydraulic cylinder.

In yet another embodiment, the hydraulic pump system is used for pushing the rod and steel plate to split a log of wood into a plurality of pieces.

In yet another embodiment, the lithium-ion batteries power the DC motor and the DC motor spins the hydraulic pump.

In yet another embodiment, the log splitter includes a switch designed for extending or retracting the track wherein the switch includes a knob for selectively extending and retracting the track of the log splitter.

In yet another embodiment, the hydraulic pump system includes a PSI gauge for configuring and indicating the pressure of the log splitter.

In yet another embodiment, an apparatus for splitting wood for outdoor firepits, woodfired ovens, boilers, campfires and more is disclosed. The apparatus uses an environmentally friendly power source and includes lithium-ion batteries, a direct current motor powered by the batteries, a hydraulic pump system activated by the direct current motor, and a rod and steel plate mechanism controlled by the hydraulic pump system wherein the hydraulic pump system facilitates movement of the rod and steel plate/wedge to section wood into at least two pieces.

In yet another embodiment, the DC motor is a 20-Amp motor or 30-Amp motor powered by at least one 20-Volt 2.0 Ah Li-Ion battery.

In yet another embodiment of the present invention, a Li-Ion battery powered log splitter is disclosed. The log splitter includes a trigger for activating the splitting action, a gear for adjusting speed of the splitting of wood wherein the gear controls the power supplied to a hydraulic pump system by a direct current motor. The direct current motor is powered by the Li-Ion battery and the hydraulic pump system is used for pushing a rod through a log of wood to cut the log into at least two pieces.

In yet another embodiment, the log splitter includes height adjustable legs for adjusting the height of the log splitter.

In yet another embodiment, the log splitter includes height adjustable and lockable wheels.

Numerous benefits and advantages of this invention will become apparent to those skilled in the art to which it pertains upon reading and understanding of the following detailed specification.

To the accomplishment of the foregoing and related ends, certain illustrative aspects of the disclosed innovation are described herein in connection with the following description and the annexed drawings. These aspects are indicative, however of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
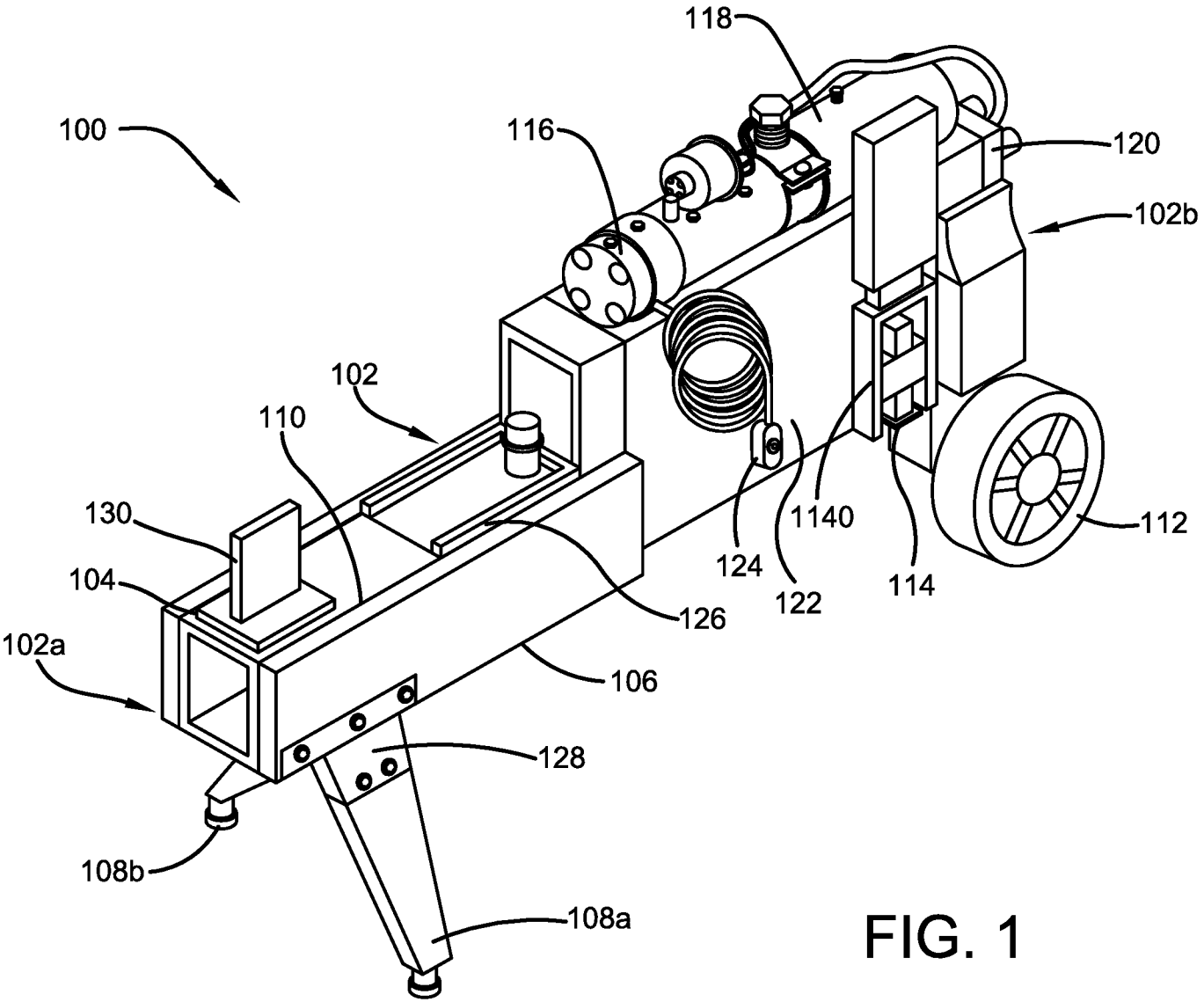
FIG. 1 illustrates a perspective view of a battery-operated portable log splitter of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long felt need in the art for a log splitter that does not cause pollution in the environment. There is also a long felt need in the art for a log splitter that does not use gas or other fossil fuels. Additionally, there is a long felt need in the art for a log splitter that requires less maintenance. Moreover, there is a long felt need in the art for a log splitter that can be used for indoor purposes and by a single person. Further, there is a long felt need in the art for a log splitter that is comparatively lightweight and easily portable. Furthermore, there is a long felt need in the art for a log splitter that does not require electrical cords during operation. Finally, there is a long felt need in the art for a log splitter that replaces gas-powered log splitters and obviates the necessity of having to deal with electrical cords or lower power performance during operation commonly associated with electric corded models.

The present invention, in one exemplary embodiment, is a novel apparatus for splitting wood for outdoor firepits, wood-fired ovens, boilers, campfires and more. The apparatus uses an environmentally friendly power source and includes lithium-ion batteries, a direct current motor powered by the batteries, a hydraulic pump system activated by the direct current motor and a rod and steel plate mechanism controlled by the hydraulic pump system wherein the hydraulic pump system facilitates movement of the rod and steel plate/wedge to section wood into at least two pieces.

Referring initially to the drawings, FIG. 1 illustrates a perspective view of the battery powered portable log splitter of the present invention in accordance with the disclosed architecture. The log splitter 100 of the present invention is designed to replace gas-powered log splitters which are harmful for the environment. Further, an integrated battery of the log splitter 100 obviates the necessity of having to deal with electrical cords or lower power performance during operation of splitting a log. More specifically, the splitter 100 includes a steel frame 102 that provides durability to the splitter 100 for handling large and bulky logs and firewood. The steel frame 102 includes a front end **102*a*** from which the logs are placed for splitting and a rear end 102*b* at which the splitter 100 is held by a user during use of the splitter device 100. The steel frame 102 includes two main frame rails 104, 106 running through the length of the log splitter 100 for maintaining a track 110 for the wood rounds to slide. The track 110 is adjustable in length and width using a toggle switch 124 enabling the log splitter 100 to receive logs of various sizes for splitting. Details of the switch 124 are described in FIG. 3.

For ease of operation, the splitter 100 includes a pair of height adjustable legs 108*a*, 108*b* at the front end 102*a* for adjusting the frame 102 vertically enabling a user to use the splitter 100 on any surface. The adjustable legs 108*a*, 108*b* are separately fastened to the frame 102 using the mechanical fasteners 128. The legs 108*a*, 108*b* are non-slipping and help in stabilizing and balancing the log splitter 100 during operation. For providing portability to the splitter 100, the device 100 includes a pair of rear wheels 112, preferably at the rear end 102*b* for rolling the device 100 on a surface. Equipped with rear wheels 112, the cutter 100 can be easily moved to different work areas.

For providing power to the log splitter 100 for operation of splitting logs and firewood, the splitter 100 includes lithium-ion batteries 114 disposed in a battery cover 1140. The lithium-ion battery 114 is preferably 20-Volt 2.0 Ah battery for providing electric power to the direct current (DC) motor 116. The battery 114 provides a constant required power to operate the log splitter 100, and thus eliminates the low power conditions associated with conventional electric corded models of the log splitters. The DC motor 116 is used for spinning the hydraulic pump system 118. The DC motor 116 used in the present embodiment is a powerful 20-Amp motor that easily splits a standard size firewood log ranging in diameter from about ten inches to about twenty-four inches. The hydraulic pump 118 upon spinning facilitates movement of the steel plate or wedge 126 and the rod 130 to section a wood log (not shown) placed on the track 110 into two or more pieces.

The battery 114 and the motor 116 are connected to each other using the internal wiring 120, and the switch 124 is connected to the hydraulic pump system 118 using the connecting wire 122. It should be appreciated that the presence of batteries 114 allows the device 100 to be used for splitting logs without using any external electric power supply. The aforementioned also eliminates additional cords and wires for using the device 100, thereby making the splitter 100 a true cordless log splitter 100.

Figure 2:
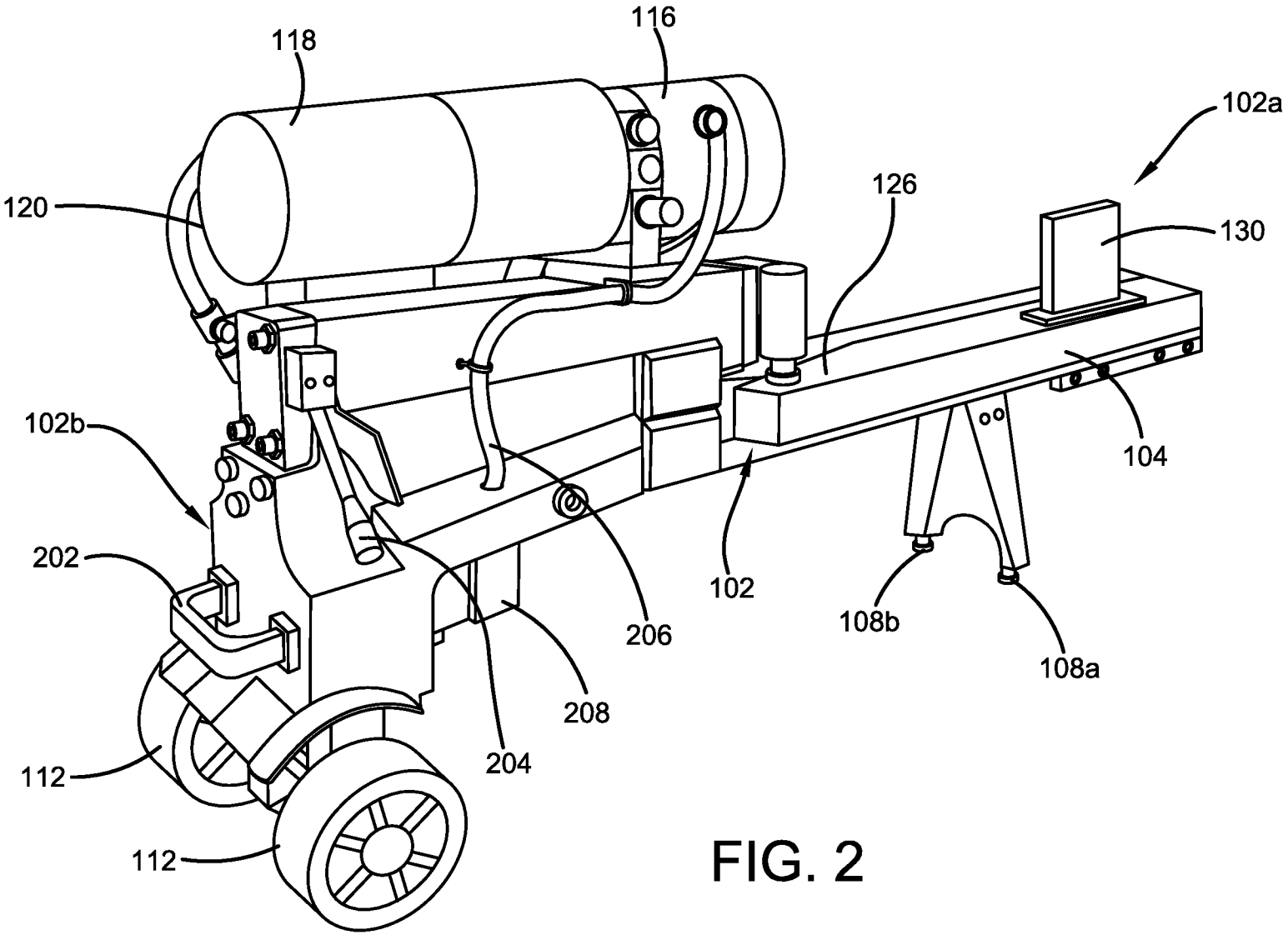
FIG. 2 illustrates a rear perspective view of the battery-operated cordless log splitter of the present invention in accordance with the disclosed architecture.

FIG. 2 illustrates a rear perspective view of the battery-operated cordless log splitter 100 of the present invention in accordance with the disclosed architecture. As shown, the splitter 100 includes a handle 202 at the rear end 102*b* of the steel frame 102, and the handle 202 is used for holding the splitter 100 during use. The splitter 100 includes a gear 204 that can be used for controlling the speed of the wedge plate 126 and the rod 130 for adjusting the splitting speed of a log of wood. The trigger 208 can be used for operating the splitter 100 and for splitting a log of wood.

The trigger 208 is coupled to the DC motor 116 through the trigger wire 206, such that the DC motor 116 fluctuates the power supplied to the hydraulic pump system 118 for operation of the splitter 100. The hydraulic pump system 118 is configured to pump hydraulic fluid from a fluid tank included in the pump system 118 to push a log placed on the steel plate 126. It should be appreciated that the splitter 100 can be used for splitting wood into pieces for campfires, outdoor fire pits, ovens and much more. Further, the size and output of the batteries 114, motor 116 and pump system 118 can increased or decreased to accommodate user need and/or preference of a desired operating PSI.

Figure 3:
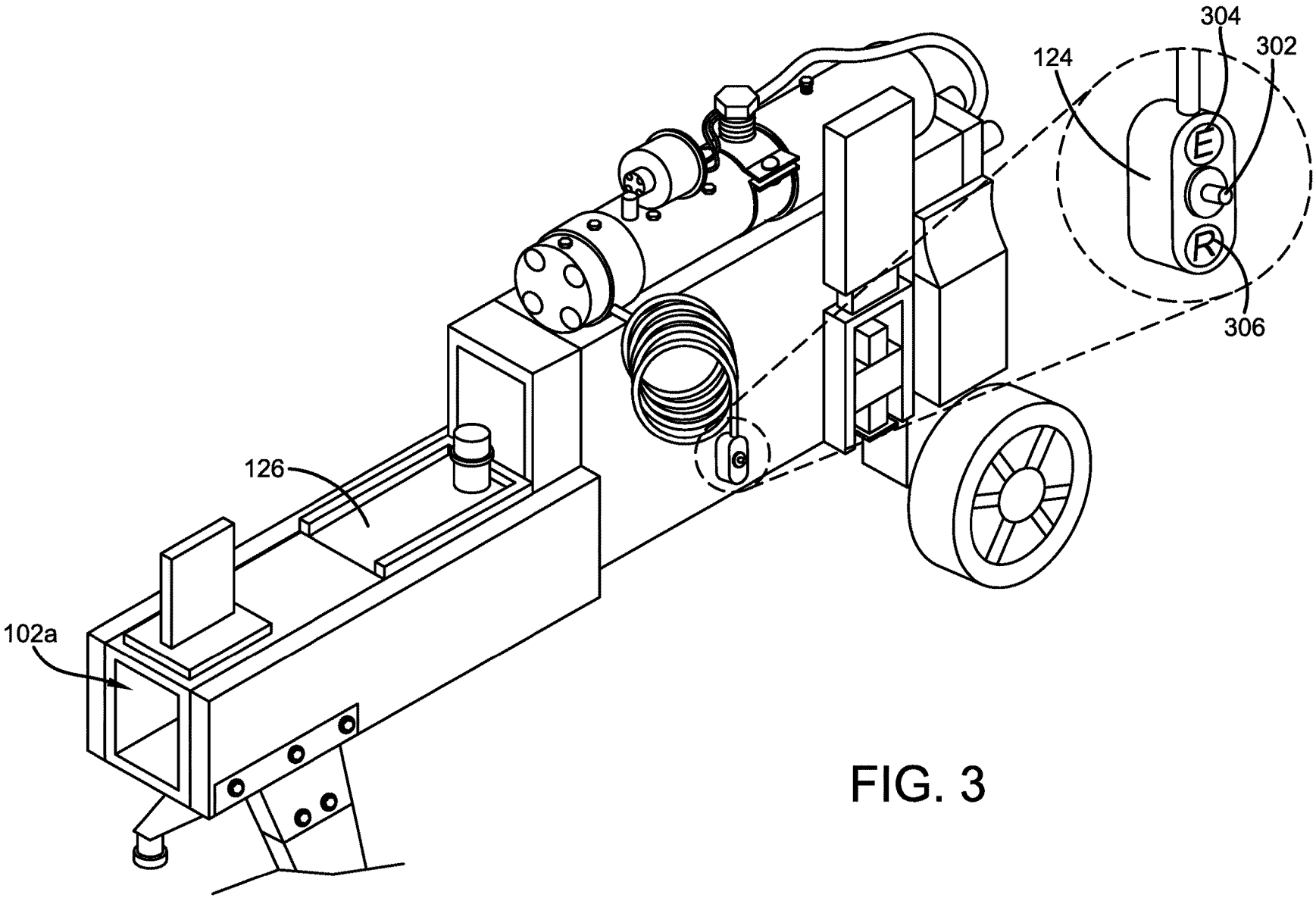
FIG. 3 illustrates a close view of a control switch used in the log splitter of the present invention in accordance with the disclosed architecture.

FIG. 3 illustrates a close view of the control switch 124 used in the log splitter 100 of the present invention in accordance with the disclosed architecture. The switch 124 is designed as a toggle switch with a knob 302 and is used for extending or retracting the wedge plate 126. More specifically, when the knob 302 is positioned towards the marking "E" 304, then the hydraulic pump pumps the fluid to glide or move the wedge plate 126 forward towards the front end 102*a*. When the knob 302 is positioned towards the marking "R" 306, then the hydraulic pump pumps the fluid in the opposite direction to glide or move back the wedge plate 126 to insert another log for splitting.

Figure 4:
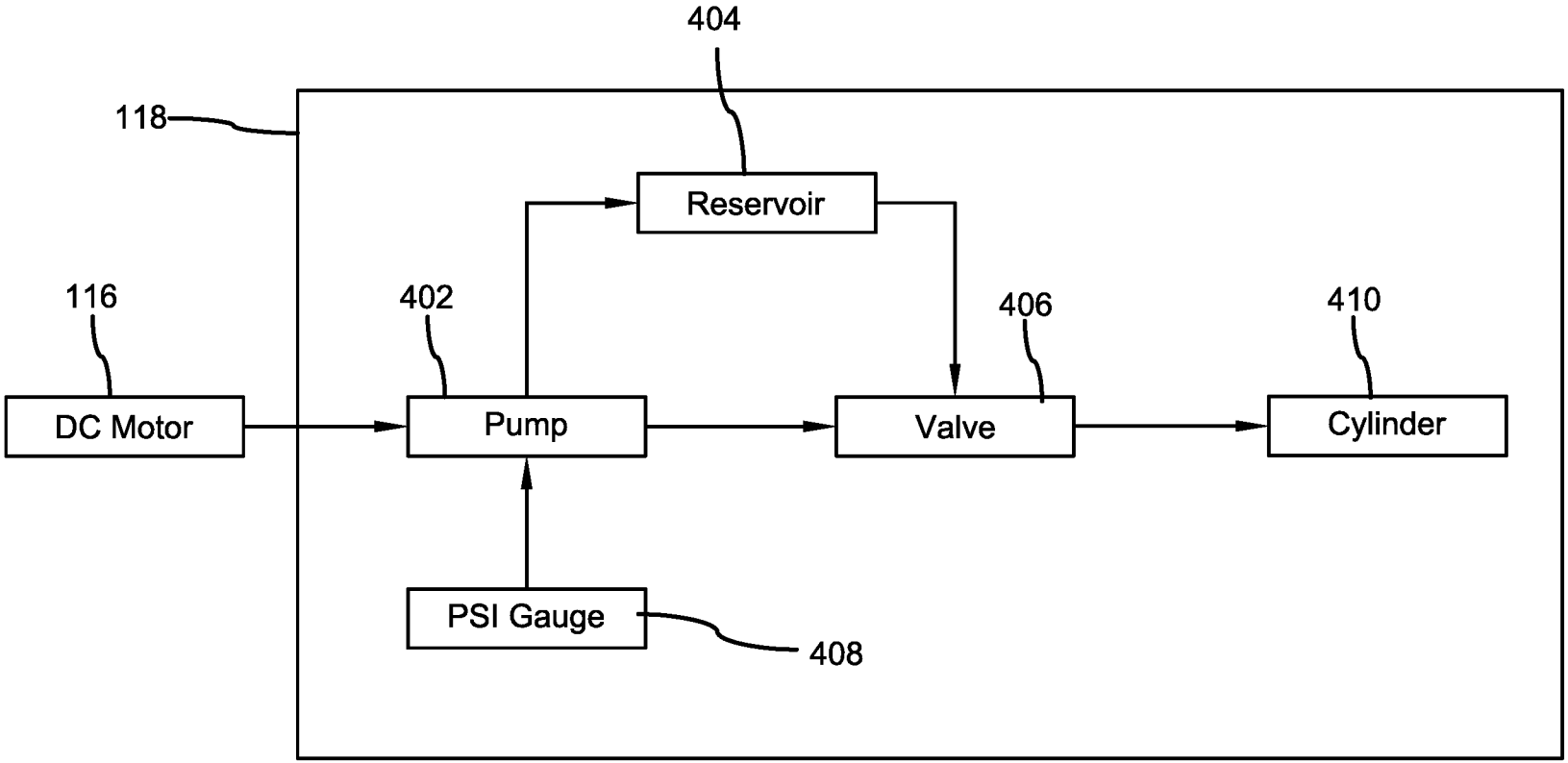
FIG. 4 illustrates a block diagram view of one potential embodiment of the hydraulic mechanism used in the log splitter of the present invention in accordance with the disclosed architecture.

FIG. 4 illustrates a block diagram view of one potential embodiment of the hydraulic mechanism used in the log splitter 100 of the present invention in accordance with the disclosed architecture. The DC motor 116 is coupled to the hydraulic pump system 118, such that the DC motor 116 provides DC electrical power to the hydraulic pump 402. The pump 402 is coupled with a PSI gauge 408 that can be configured as per the preference (i.e. pre-selectable) of a user and intended use of the log splitter 100. Based on the value of the PSI gauge 408, the pump 402 pushes the fluid in the reservoir 404 such that the valve 406 actuates the hydraulic cylinder 410 to extend or retract the log splitter wedge plate for splitting a log.

More specifically, the hydraulic oil pump 402 creates a stream of high-pressure oil from the reservoir 404, which runs to the valve 406. The valve 406 lets the operator of the splitter 100 actuate the hydraulic cylinder 410 to split a log. The PSI gauge 408 can be internal to the splitter 100 or can be removably attached to the splitter 100 in accordance with various embodiments of the present invention.

Figure 5:
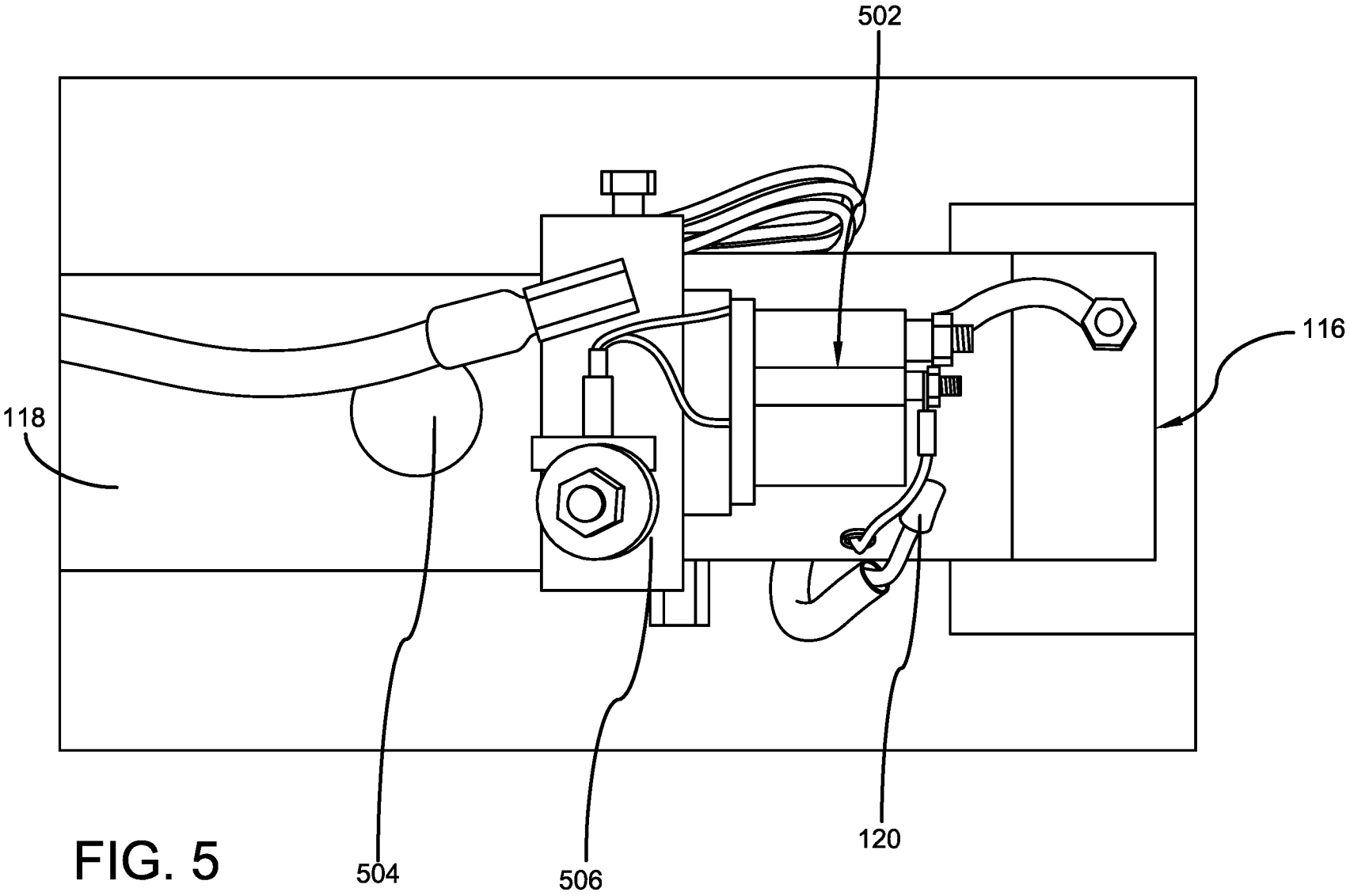
FIG. 5 illustrates a partial top view of the battery-operated log splitter of the present invention showing the DC motor and the hydraulic pump system in accordance with the disclosed architecture.

FIG. 5 illustrates a partial top view of the battery-operated log splitter 100 of the present invention showing the DC motor 116 and the hydraulic pump system 118 in accordance with the disclosed architecture. As shown, the DC motor 116 and the hydraulic pump system 118 are connected to each other through a physical connector 506 that removably and physically attaches the DC motor 116 and the hydraulic pump system 118. Further, the DC motor 116 is essential to the operation of the splitter 100 as the motor 116 provides DC power to the hydraulic pump system 118. The DC power is supplied from the motor 116 to the pump system 118 via the electric coupler 502. The coupler 502 forms the electric connection and path between the motor 116 and the pump system 118.

For refilling fluid in the reservoir 404 of the pump system 118, a removable cap 504 is disposed. The cap 504 can be removed to refill the fluid that is passed to the valve of the system 118 as a stream, thereby actuating the hydraulic cylinder as described in FIG. 4 for effectively splitting wood via the rod and steel plate mechanism.

It should be appreciated that the log splitter 100 of the present invention enables users to maintain a considerable amount of wood for outdoor firepits, woodfired ovens, boilers, campfires and more. Further, due to the combination of the battery 114, DC motor 116 and the pump system 118, the log splitter 100 obviates the need to use gas and deal with electrical cords, or lower power performance during operation commonly associated with electric corded models. Importantly, the log splitter 100 may be a mobile and portable unit, or a larger industrial sized tow behind unit.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "battery-operated cordless log splitter", "log splitter", "Li-Ion battery powered portable log splitter", "splitter", "cordless log splitter", and "battery-operated log splitter" are interchangeable and refer to the battery-operated cordless log splitter 100 of the present invention.

Notwithstanding the forgoing, the battery-operated cordless log splitter 100 of the present invention can be of any suitable size and configuration as is known in the art without affecting the overall concept of the invention, provided that it accomplishes the above-stated objectives. One of ordinary skill in the art will appreciate that the battery-operated cordless log splitter 100 as shown in the FIGS. are for illustrative purposes only, and that many other sizes and shapes of the battery-operated cordless log splitter 100 are well within the scope of the present disclosure. Although the dimensions of the battery-operated cordless log splitter 100 are important design parameters for user convenience, the battery-operated cordless log splitter 100 can be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A battery powered log splitter comprising:

a frame having a front end, a rear end and two main frame rails running a length of said battery powered log splitter for maintaining a track for a log to slide;

a toggle switch that enables said track to be adjustable in length and width;

a pair of height adjustable legs positioned at the front end for adjusting a height of said frame, wherein each of said pair of height adjustable legs is separately fastened to said frame;

a pair of rear wheels positioned at the rear end;

a motor;

at least one battery for providing electric power to said motor; and a hydraulic pump system.

2. The battery powered log splitter of claim 1 further comprising a wedge plate, wherein said wedge plate is repositionable along the track by the hydraulic pump system.

3. The battery powered log splitter of claim 2 further comprising a gear for controlling a speed of said wedge plate, and a rod for adjusting a splitting speed of the log.

4. The battery powered log splitter of claim 3 further comprising a trigger for operating said battery powered log splitter, wherein said trigger is coupled to the motor through a trigger wire such that said motor fluctuates the electric power supplied to said hydraulic pump system for operation of said battery powered log splitter.

5. The battery powered log splitter of claim 4 further comprising a control switch having a toggle switch and a knob for extending or retracting said wedge plate along the track.

6. The battery powered log splitter of claim 5, wherein said motor provides DC electrical power to said hydraulic pump system.

7. The battery powered log splitter of claim 6, wherein said hydraulic pump system comprises a PSI gauge for actuation of said hydraulic pump system at a pre-selectable level.

8. The battery powered log splitter of claim 7, wherein said hydraulic pump system is detachable from said motor.

9. A battery powered log splitter comprising:

a frame having a front end, a rear end and two main frame rails running a length of said battery powered log splitter for maintaining a track for a log to slide;

a toggle switch that enables said track to be adjustable in length and width;

a pair of height adjustable legs;

a pair of rear wheels;

a 20-Amp motor;

at least one 20-Volt 2.0 Ah battery for providing electric power to said 20-Amp motor; and a hydraulic pump system comprising a PSI gauge for actuation of said hydraulic pump system at a user specified level.

10. The battery powered log splitter of claim 9 further comprising a wedge plate, wherein said hydraulic pump system repositions the wedge plate along the track and against the log for sectioning the log into two or more pieces.

11. The battery powered log splitter of claim 10 further comprising a gear for controlling a speed of said wedge plate.

12. The battery powered log splitter of claim 11 further comprising a trigger for operating said battery powered log splitter, wherein said trigger is coupled to said 20-Amp motor.

13. The battery powered log splitter of claim 12 further comprising a toggle switch and a knob for extending or retracting said wedge plate along said track.

14. The battery powered log splitter of claim 13, wherein said hydraulic pump is detachable from said 20-Amp motor.

15. A battery powered log splitter comprising:

a steel frame comprised of a front end from which a log is placed for splitting, a rear end at which said battery powered log splitter is held by a user during operation thereof, and a track upon which the log can slide, wherein said track is adjustable in length and width using a toggle switch;

a direct current (DC) motor;

a plurality of lithium-ion batteries including a 20-Volt 2.0 Ah battery for providing electric power to the DC motor, wherein said plurality of lithium-ion batteries provide constant electric power to operate said battery powered log splitter;

a hydraulic pump system having a PSI gauge, wherein said DC motor provides DC electrical power to said hydraulic pump system;

a wedge steel plate that is repositionable and that is powered by said hydraulic pump system; and a control switch including a toggle switch having a knob for extending or retracting said wedge steel plate, wherein said hydraulic pump system pumps a fluid in a first direction to move said wedge steel plate in a first direction and pumps the fluid in a second direction to move said wedge steel plate in a second direction.

16. The battery powered log splitter of claim 15 further comprising a gear for controlling the speed of said wedge steel plate and a rod for adjusting a splitting speed of the logs.

17. The battery powered log splitter of claim 16 further comprising a trigger for operating said battery powered log splitter, wherein said trigger is coupled to said DC motor through a trigger wire such that said DC motor fluctuates the electric power supplied to said hydraulic pump system for operation of said battery powered log splitter.

18. The battery powered log splitter of claim 17, wherein said hydraulic pump is detachable from said DC motor.

19. The battery powered log splitter of claim 18, wherein said front end includes a pair of height adjustable legs for adjusting a height of said steel frame, and further wherein each said pair of height adjustable legs is separately fastened to said steel frame.

20. The battery powered log splitter of claim 19, wherein said rear end includes a pair of rear wheels.

* * * * *